US009576536B2

(12) United States Patent
Kwon et al.

(10) Patent No.: US 9,576,536 B2
(45) Date of Patent: Feb. 21, 2017

(54) DISPLAY DEVICE AND DRIVING METHOD THEREOF

(71) Applicants: SAMSUNG DISPLAY CO., LTD., Yongin, Gyeonggi-Do (KR); KOREA ADVANCED INSTITUTE OF SCIENCE AND TECHNOLOGY, Yuseong-gu, Daejeon (KR)

(72) Inventors: Oh Jo Kwon, Suwon-si (KR); Kyung Youl Min, Hwaseong-si (KR); Choong Sun Shin, Yongin-si (KR); Hee Sun Ahn, Suwon-si (KR); Hyun Sik Kim, Daejeon (KR); Jun Suk Bang, Daejeon (KR); Gyu Hyeong Cho, Daejeon (KR)

(73) Assignees: Samsung Display Co., Ltd., Yongin-si (KR); Korea Advanced Institute of Science and Technology, Daejeon (KR)

( * ) Notice: Subject to any disclaimer, the term of this patent is extended or adjusted under 35 U.S.C. 154(b) by 221 days.

(21) Appl. No.: 14/218,956

(22) Filed: Mar. 18, 2014

(65) Prior Publication Data

US 2015/0103062 A1 Apr. 16, 2015

(30) Foreign Application Priority Data

Oct. 10, 2013 (KR) ..... 10-2013-0120601

(51) Int. Cl.
*G09G 3/36* (2006.01)
*G09G 3/32* (2016.01)

(52) U.S. Cl.
CPC .... *G09G 3/3291* (2013.01); *G09G 2300/0814* (2013.01); *G09G 2300/0819* (2013.01); *G09G 2320/0295* (2013.01)

(58) Field of Classification Search
CPC ..... G09G 3/3233; G09G 3/3283; G09G 3/006
See application file for complete search history.

(56) References Cited

U.S. PATENT DOCUMENTS 6,404,139 B1 * 6/2002 Sasaki ..... G09G 3/22 315/169.3
6,806,497 B2 * 10/2004 Jo ..... G09G 3/006 257/59

(Continued)

FOREIGN PATENT DOCUMENTS

KR 10-2008-0012051 A 2/2008
KR 10-2011-0098914 9/2011

OTHER PUBLICATIONS

Chaji et al., A Current-Mode Comparator for Digital Calibration of Amorphous Silicon AMOLED Displays, IEEE Transactions on Circuits and Systems-II: Express Briefs, vol. 55, No. 7, Jul. 2008, pp. 614-618.

*Primary Examiner* — Dorothy Harris
(74) *Attorney, Agent, or Firm* — Lewis Roca Rothgerber Christie LLP

(57) ABSTRACT

A display device according to an embodiment of the present invention includes: a pixel configured to emit light according to a data signal supplied to a data line, a power source voltage supplier configured to supply a power source voltage to the pixel, a driving transistor configured to drive the pixel to be emitted according to the data signal and the power source voltage, and a sensor configured to supply a test signal to a data line and to detect a sensing current flowing to the data line through the driving transistor according to the test signal.

15 Claims, 5 Drawing Sheets

(56) References Cited

U.S. PATENT DOCUMENTS

| | | | | |
|---|---|---|---|---|
| 8,115,707 | B2 | 2/2012 | Nathan et al. | |
| 8,212,581 | B2 * | 7/2012 | Levey | G09G 3/006 313/463 |
| 2009/0140959 | A1 * | 6/2009 | Nam | G09G 3/3233 345/76 |
| 2010/0123699 | A1 | 5/2010 | Leon et al. | |
| 2011/0130981 | A1 | 6/2011 | Chaji et al. | |
| 2013/0003230 | A1 * | 1/2013 | Kojima | H05B 33/089 361/18 |
| 2013/0082615 | A1 * | 4/2013 | Williams | H05B 33/0827 315/186 |

* cited by examiner

DISPLAY DEVICE AND DRIVING METHOD THEREOF

CROSS-REFERENCE TO RELATED APPLICATION

This application claims priority to and the benefit of Korean Patent Application No. 10-2013-0120601 filed in the Korean Intellectual Property Office on Oct. 10, 2013, the entire contents of which are incorporated herein by reference.

BACKGROUND

1. Field

Embodiments of the present invention relate to a display device and a driving method of a display device.

2. Discussion of the Background

An organic light emitting diode display among flat panel displays uses an organic light emitting diode, which generates light by recoupling electrons and holes to display an image. Since the organic light emitting diode display has a fast response speed, is driven by low power consumption, and has excellent luminous efficiency, luminance, and viewing angle, the organic light emitting diode display has received attention.

In general, the organic light emitting diode display is classified into a passive matrix organic light emitting diode (PMOLED) display, and an active matrix organic light emitting diode (AMOLED) display, as determined by a driving mode of the organic light emitting diode.

From the viewpoint of resolution, contrast, and operation speed, the active matrix organic light emitting diode (AMOLED) display that emits light selected for each unit pixel has become mainstream.

In one pixel of the active matrix OLED display (hereinafter, referred to as an organic light emitting diode display), a degree of light emission from the organic light emitting diode is controlled by controlling a driving transistor that supplies a driving current to the organic light emitting diode according to a data voltage.

However, the organic light emitting device generates characteristic differences, such as an operation voltage Vth, and such as mobility of the driving transistor per pixel. These differences may be due to process variation, such that an amount of current for driving the organic light emitting diode is non-uniform. As a result, a luminance variation between the pixels may be generated.

In comparative examples, a data compensation method for compensating input data according to a measuring result, which is reached after measuring the current of each pixel, has been researched. However, to measure the pixel current, an additional feedback line is usually required. Further, after applying a test voltage, a parasitic component exists in the feedback line such that a measuring time of the pixel current is delayed, thereby causing measuring at a high speed to be difficult.

The above information disclosed in this Background section is only for enhancement of understanding of the background of the invention, and therefore it may contain information that does not form the prior art that is already known in this country to a person of ordinary skill in the art.

SUMMARY

Example embodiments of the present invention provide a display device for speedily measuring a current of each pixel using a structure to compensate luminance variation between pixels, and a driving method thereof.

Also provided are a display device without an additional feedback line to measure the pixel current, and a driving method thereof.

Technical aspects to be achieved in embodiments of the present invention are not limited to the above-described technical aspects, and other technical aspects that are not described may be clearly understood by those skilled in the art from the following description.

According to an embodiment of the present invention, there is provided a display device including a pixel configured to emit light according to a data signal supplied to a data line, a power source voltage supplier configured to supply a power source voltage to the pixel, a driving transistor configured to drive the pixel according to the data signal and the power source voltage, and a sensor configured to supply a test signal to the data line and to detect a sensing current flowing to the data line through the driving transistor according to the test signal.

The sensor may include an amplifier configured to generate an output voltage according to a voltage difference input to a plurality of input terminals, an output terminal coupled to the amplifier and configured to supply the test signal to the data line through a plurality of transistors configured to be driven according to the output voltage, a current sensor coupled to the output terminal and configured to detect the sensing current, and a switching element coupled to the output terminal and configured to drive the sensing current.

The plurality of transistors may include a first transistor comprising a first terminal coupled to a voltage source, and a second terminal coupled to the data line and to the input terminal of the amplifier at a first node, and a second transistor comprising a first terminal coupled to the current sensor, and a second terminal coupled to the first node.

The first transistor may be configured to operate according to the output voltage and may be configured to supply a current supplied from the voltage source to the first node.

The display device may further include a first switching transistor including a first terminal coupled to the data line, and a second terminal coupled to a gate of the driving transistor and configured to operate according to a scanning signal supplied to a scan line, and a second switching transistor comprising a first terminal coupled to the driving transistor, and a second terminal coupled to the first switching transistor at a second node and configured to operate according to the scanning signal.

A switching element, which may be configured to drive the sensing current, may be configured to be turned off when a voltage of the second node is substantially equivalent to a voltage of the test signal.

The current sensor may include a current mirror.

The current sensor may include a sensing resistor, and may be configured to detect a voltage of the sensing resistor according to the sensing current.

The current sensor may include a sensing capacitor, and may be configured to detect a charged voltage of the sensing capacitor corresponding to the sensing current.

The display device may further include a data compensator configured to compensate the data signal as a compensation value corresponding to a value of the sensing current.

According to another embodiment of the present invention, there is provided a method for driving a display device including a pixel configured to emit a light according to a data signal supplied to a data line, a power source voltage supplier configured to supply a power source voltage to the pixel, and a driving transistor configured to drive the pixel according to the power source voltage, the method including supplying a test signal to the driving transistor through the data line, and detecting a sensing current flowing to the data line according to the test signal through the driving transistor.

The supplying of the test signal may include, applying voltages to a plurality of input terminals of an amplifier, supplying an output voltage, which is generated in the amplifier according to a difference of the voltages applied to the plurality of input terminals, to a gate of a plurality of transistors, and applying the test signal to the data line from a voltage source coupled to at least one terminal of one of the plurality of transistors according to the output voltage supplied to the gate.

The plurality of transistors may include a first transistor including a first terminal coupled to the voltage source, and a second terminal coupled to the data line and to at least one of the input terminals of the amplifier at a first node, and a second transistor including a first terminal coupled to a current sensor and a second terminal coupled to the first node.

The supply of the test signal may further include, supplying a scanning signal to a scan line coupled to a gate of a first switching transistor including a first terminal coupled to the data line, and a second terminal coupled to a gate of the driving transistor, and supplying the scanning signal to the scan line coupled to a gate of a second switching transistor including a first terminal coupled to the driving transistor, and a second terminal coupled to the first switching transistor at a second node.

The detecting the sensing current may include stopping a driving of a switching element coupled to the first terminal of the second transistor to supply the sensing current to the current sensor when a voltage of the second node is substantially equivalent to a voltage of the test signal.

The current sensor may include a current mirror and a current output from the current mirror may be detected in the detecting of the sensing current.

The current sensor may further include a sensing resistor, and a voltage value of the sensing resistor corresponding to the sensing current may be detected in the detecting of the sensing current.

The current sensor may further include a sensing capacitor, and a charged voltage value of the sensing capacitor corresponding to the sensing current may be detected in the detecting of the sensing current.

The method may further include compensating the data signal as a compensation value corresponding to a value of the sensing current.

An aspect of the display device according to the present invention will be described.

According to one example embodiment of the present invention, the pixel current of the driving transistor may be measured at a high speed.

According to one example embodiment of the present invention, a feedback line to measure the pixel current is not separately required such that the display panel circuit may be down-sized.

The above aspects in the present invention are not limited to the aforementioned aspects, and other aspects not described above will be apparent to those skilled in the art from the disclosure of the present invention.

DETAILED DESCRIPTION

Figure 1:
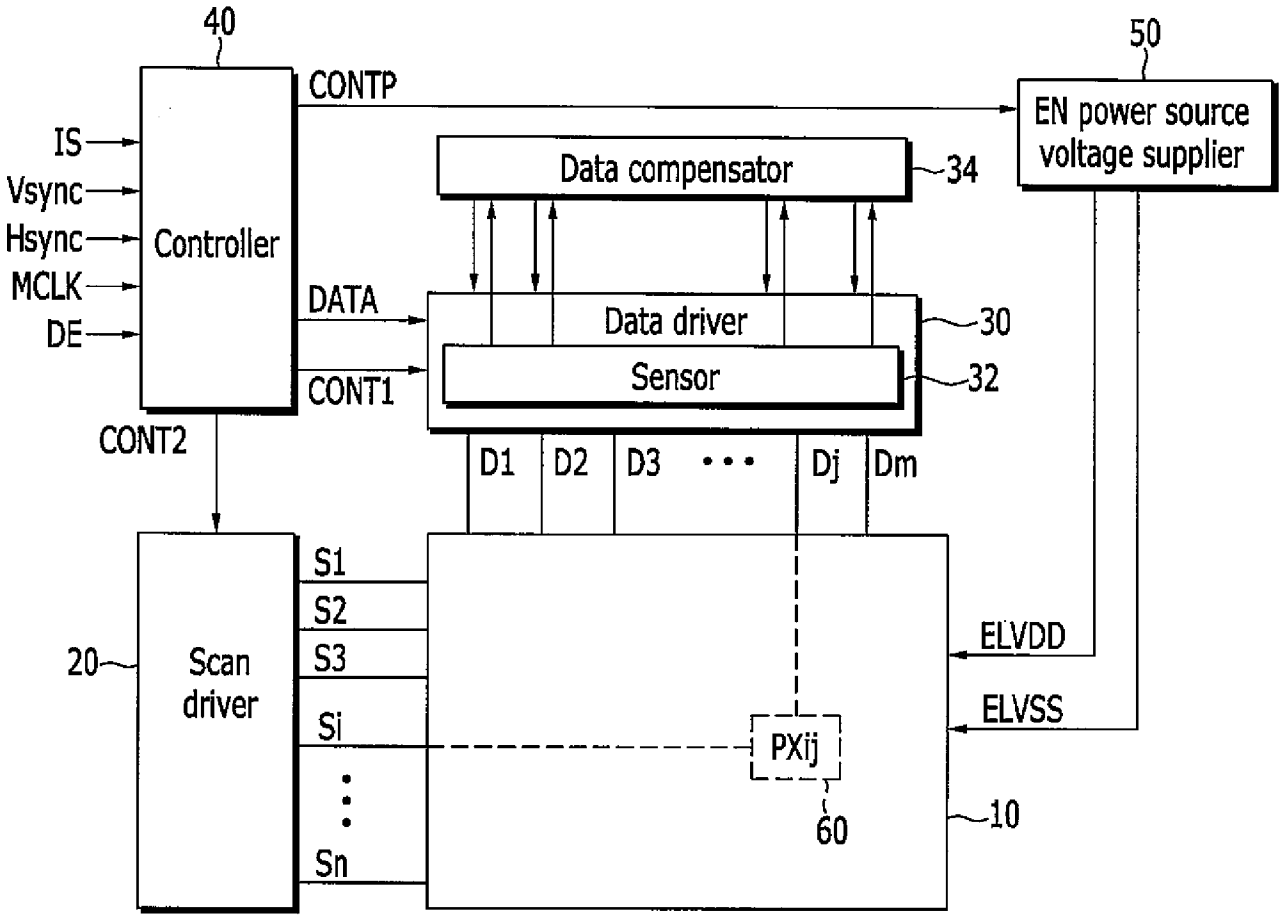
FIG. 1 is a block diagram illustrating a display device according to an embodiment of the present invention.

Embodiments of the present invention will be described more fully hereinafter with reference to the accompanying drawings, in which example embodiments of the invention are shown. As those skilled in the art would realize, the described embodiments may be modified in various different ways, all without departing from the spirit or scope of the present invention.

In addition, parts that are not related to the description are omitted for clear description of the present invention, and like reference numerals designate like elements and similar constituent elements throughout the specification.

Throughout this specification and the claims, when it is described that an element is "coupled" to another element, the element may be "directly coupled" to the other element, or may be "electrically coupled" to the other element through one or more other elements. In addition, unless explicitly described to the contrary, the word "comprise" and variations thereof, such as "comprises" or "comprising," will be understood to imply the inclusion of stated elements, but not the exclusion of any other elements.

FIG. 1 is a block diagram of a schematic configuration of a display device according to an embodiment of the present invention.

Referring to FIG. 1, a display device includes a display unit 10 including a plurality of pixels, a scan driver 20, a data driver 30, a controller 40, a power source voltage supplier 50, a sensor 32, and a data compensator 34.

The display unit 10 is a display panel including a plurality of pixels coupled to (e.g., connected to) a corresponding scanning line among a plurality of scanning lines S1-Sn, and coupled to a corresponding data line among a plurality of data lines D1-Dm. Each of the plurality of pixels responds to an image data signal transferred to the corresponding pixel to display an image.

The plurality of pixels included in the display unit 10 are respectively coupled to the plurality of scan lines S1-Sn and coupled to the plurality of data lines D1-Dm to be arranged substantially in a matrix form. The plurality of scan lines S1-Sn extend substantially in a row direction to be parallel to each other. The plurality of data lines D1-Dm extend substantially in a column direction to be parallel to each other. Each of the plurality of pixels of the display unit 10 receives a power voltage from the power source voltage supplier 50 to receive a first driving voltage ELVDD and a second driving voltage ELVSS.

The scan driver 20 is coupled to the display unit 10 through the plurality of scan lines S1-Sn. The scan driver 20 generates a plurality of scan signals capable of activating each pixel of the display unit 10 according to a scan control signal CONT2, which is received from the controller 40, to transfer the generated scan signals to corresponding scan lines S1-Sn.

The scan control signal CONT2 is an operation control signal of the scan driver 20, and is generated and transferred from the controller 40. The scan control Signal CONT2 may include a scan start signal SSP, a clock signal CLK, and the like. The scan start signal SSP is a signal generating a first scan signal for displaying an image for one frame. The clock signal CLK is a synchronization signal for sequentially applying a scan signal to the plurality of scan lines S1-Sn.

The data driver 30 is coupled to each pixel of the display unit 10 through the plurality of data lines D1-Dm. The data driver 30 receives a data control signal CONT1 and an image data signal DATA from the controller 40 to transfer the received image data signal DATA to a corresponding data line among the plurality of data lines D1-Dm according to the data control signal CONT1.

The data control signal CONT1 is an operation control signal of the data driver 30 that is generated and transferred from the controller 40.

The data driver 30 selects a gray voltage according to the image data signal DATA to transfer the selected gray voltage to the plurality of data lines D1-Dm as a data signal.

The controller 40 receives externally input image information IS, and also receives an input control signal controlling display of the image information IS. The image information IS stores luminance information of each pixel PX of the display unit 10, and luminance may be classified into a grayscale number (e.g., a predetermined number of grays), for example, 1024, 256, or 64.

Meanwhile, an example of the input control signal transferred to the controller 40 includes a vertical synchronization signal Vsync, a horizontal synchronizing signal Hsync, a main clock signal MCLK, a data enable signal DE, and the like.

The controller 40 appropriately image-processes the input image information IS based on the input image information IS and the input control signal in accordance with an operation condition of the display unit 10 and the data driver 30. In detail, the controller 40 generates the image data signal DATA through image processing processes, such as gamma correction, luminance compensation, and the like with respect to the image information IS.

Further, the controller 40 transfers to the scan driver 20 the scan control signal CONT2 for controlling an operation of the scan driver 20. The controller 40 generates the data control signal CONT1 for controlling an operation of the data driver 30, and transfers the generated data control signal CONT1, along with the image data signal DATA, to the data driver 30 through the image processing process.

Next, the controller 40 may control driving of the power source voltage supplier 50. The power source voltage supplier 50 supplies a power source voltage to drive each pixel of the display unit 10.

For example, the controller 40 is coupled to the power source voltage supplier 50 via a driving terminal EN to transmit a driving signal CONTP to the power source voltage supplier 50, thereby driving the power source voltage supplier 50.

Also, the controller 40 controls the switching operation of a switching element included in the sensor 32, and thereby the sensor 32 may be configured to control an operation voltage of the driving transistor of the pixels, and configured to control a process of extracting degradation information of the organic light emitting diode. Also, an output process of a test voltage input and a sensing current may be controlled, and the data driver 30 may be controlled for the image data signal DATA to be transmitted through the data lines D1 to Dm according to the image information IS.

Next, the power source voltage supplier 50 is electrically coupled to (e.g., electrically connected to) each pixel through a power source wiring for supplying a power source voltage to each pixel of the display unit 10. The power source voltage may be a first power source voltage ELVDD and a second power source voltage ELVSS of a high level.

Next, the sensor 32 is coupled to (e.g., connected to) the data lines D1-Dm to measure each sensing current of the plurality of pixels. The sensor 32 senses each current or voltage of the plurality of pixels to calculate an optimized driving voltage through the data lines D1-Dm respectively coupled to the plurality of pixels of the display unit 10.

Here, the timing when the sensor 32 extracts the operation voltage of the driving transistor of the pixels, along with the degradation information of the organic light emitting diode of the pixels, is not limited. However, this operation may be performed whenever power is applied to the organic light emitting device, or before the display device is initially shipped as a product. The sensor 32 may be operable periodically and automatically, and the sensor 32 may also be set to be randomly operated by a user's setting.

Meanwhile, in the embodiment of FIG. 1, the data lines D1 to Dm may be used to measure the sensing current of the pixel 60. However, this is an example embodiment, and a test voltage supplied to the data line and supplied to a sensing current output line coupled to the pixel 60 may be separately provided to measure the sensing current of the pixel 60.

In the example embodiment, which separates the sensing current output line and the test voltage input line, a plurality of sensing current output lines separated from the data lines D1 to Dm and coupled to the sensor 32, as well as a plurality of pixels, may be added.

Here, the time for the sensor 32 to extract the operation voltage of the driving transistor of the pixels, and to extract deterioration information of the organic light emitting diode (OLED), is not specified, and the extraction by the sensor 32 may be performed each time power is supplied to the organic light emitting diode (OLED) display, or may be performed before the initial display device is shipped as a product. The sensor 32 may be operable periodically and automatically, and may also be set to be randomly operated by the user's setting.

Next, the data compensator 34 may compensate the data by using the measured sensing current of each pixel. In other words, the data compensator 34 may detect a compensation value to compensate variation of the operation voltage, and to compensate the mobility of the driving transistor, according to the sensing current of each pixel, and may store the compensation value to a memory. Also, the data compensator 34 may compensate the input data by using the stored compensation value.

For example, the data compensator 34 detects the operation voltage representing the characteristic of the driving transistor and the mobility variation (e.g., a mobility ratio between the corresponding pixel and a reference pixel) between the pixels, detects an offset value to compensate the detected operation voltage, and also detects a gain value to compensate the mobility variation as the compensation value to store them to a memory as a look-up table. The mobility variation, the operation voltage, and the gain value are detected from the test voltage and the measured sensing current of each pixel by calculating the sensing current of the operation voltage and the mobility of the driving transistor.

The data compensator 34 may compensate by using an offset value and a gain value of each pixel stored with the data signal. For example, the controller 40 multiplies the gain value and the data signal, and then adds the offset value and the data signal to compensate the data signal.

In the example embodiment of FIG. 1, the data compensator 34 is realized as an individual element, and without being restricted to this, the data compensator 34 may be included in the controller 40 or the sensor 32.

On the other hand, and according to an embodiment of the present invention, the controller 40 may compensate the data signal using the data compensator 34 according to the driving method of the display device. However, this is only an example embodiment, and the controller 40 may perform the function of the data compensator 34.

Figure 2:
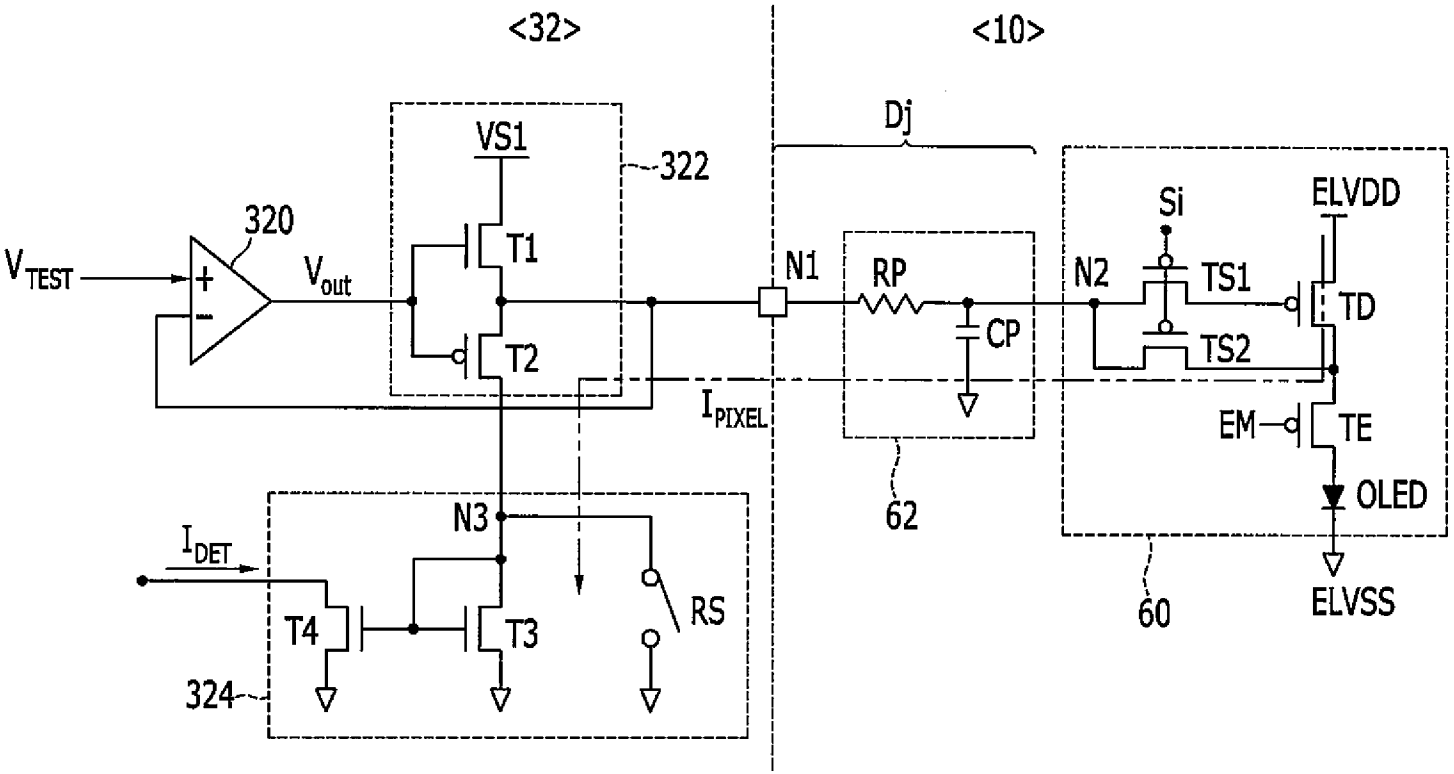
FIG. 2 is a circuit diagram of one example of a display unit and a sensor of a display device according to the embodiment of FIG. 1.

FIG. 2 is a circuit diagram of one example of a structure of the pixel 60 included in the display unit 10 and the sensor 32 coupled to (e.g., connected to) the pixel 60 in the display device according to the example embodiment of FIG. 1. In detail, as the pixel 60 provided in a region where the i-th scanning line Si crosses the j-th data line Dj among the plurality of pixels included in the display unit 10 of FIG. 1, the structure of the pixel PXij (60) coupled to the i-th scanning line Si and the j-th data line Dj is shown.

Referring to FIG. 2, the sensor 32 may include an amplifier 320, an output terminal 322, and a current sensor 324, and may be coupled to the j-th data line Dj.

A non-inversion terminal (+) of the amplifier 320 is applied with a test voltage VTEST, and an inversion terminal (−) is applied with a voltage output from the output terminal 322. The amplifier 320 may generate an output voltage VOUT according to a voltage difference between the non-inversion terminal (+) and the inversion terminal (−).

The output terminal 322 includes a first transistor T1 and a second transistor T2. If the first transistor T1 of the output terminal is turned on, the current is supplied from a voltage source VS1. If the second transistor T2 of the output terminal is turned on, a ground current is sunk.

The voltage output from the output terminal 322 is increased by the supplied current, or is decreased by the sink current. If the output voltage of the output terminal 322 is increased, the output voltage VOUT of the amplifier 320 is decreased. If the output voltage of the output terminal 322 is decreased, the output voltage VOUT of the amplifier 320 is increased.

If the output voltage VOUT of the amplifier 320 is decreased, the sink current is increased, and the voltage output from the output terminal 322 is decreased. If the output voltage VOUT of the amplifier 320 is increased, the supplied current is increased, and the voltage output from the output terminal 322 is increased.

By the supply of the test voltage VTEST, the output voltage of the output terminal 322 may be controlled as described above, and the output voltage of the output terminal 322 becomes substantially the same voltage as the test voltage VTEST. Thus, the voltage of the inversion terminal (−) of the amplifier 320 may be maintained as the test voltage VTEST.

One terminal of the first transistor T1 may be coupled to the j-th data line Dj and to one terminal of the second transistor T2 by a first node N1. Also, the voltage source VS1 may be coupled to the other terminal of the first transistor T1. The first transistor T1 may be an n-channel type transistor.

The other terminal of the second transistor T2 may be coupled to the current sensor 324 by a third node N3. The second transistor T2 may be a p-channel type transistor.

The current sensor 324 may include a switching element RS and current mirrors T3 and T4. The switching element RS and the current mirrors T3 and T4 may be coupled together (e.g., connected together) at the third node N3.

On the other hand, the switching element RS may be turned on or turned off according to the control of the controller 40, as described in FIG. 1.

The current mirrors T3 and T4 may include a third transistor T3 and a fourth transistor T4. The current mirrors T3 and T4 copy a current IPIXEL flowing in from the second transistor T2 to generate a detection current IDET.

For example, the current is inflowed (e.g., flows in) to one terminal of the third transistor T3, and the current flowing to the third transistor T3 is copied with a predetermined ratio, and a copied current flows to the fourth transistor T4. For the convenience of explanation, it is assumed that the predetermined ratio is 1:1. Accordingly, when the sensing current IPIXEL flows to the third transistor T3, the ground detection current IDET flows from the fourth transistor T4, and the detection current IDET has substantially the same value as the sensing current IPIXEL.

Also, the first node N1 may be coupled to the j-th data line Dj. To measure the sensing current IPIXEL, when the scanning signal is applied to the scan line Si coupled to the pixel 60, a plurality of other pixels coupled to the data line Dj coupled to the first node N1 and to the pixel 60 may operate as a parasitic element 62. The parasitic element 62 may include a parasitic resistor RP and a parasitic capacitor CP.

The pixel 60 includes an organic light emitting diode (OLED) as an organic light emitting element, and includes a pixel driving circuit to control the organic light emitting diode (OLED). The pixel driving circuit includes a driving transistor TD, a first switching transistor TS1, and a second switching transistor TS2. Also, the pixel driving circuit may further include a light emission transistor TE.

In FIG. 2, the pixel 60 includes four transistors. However, the pixel circuit structure of the display device is not limited thereto, and various structures may be provided.

In the pixel 60 of FIG. 2, the first switching transistor TS1 includes a gate electrode coupled to the scanning line Si, a source electrode coupled to the data line Dj, and a drain electrode coupled to a gate electrode of the driving transistor TD.

Also, the second switching transistor TS2 includes the gate electrode coupled to (e.g., connected to) the scanning line Si, the source electrode coupled to the data line Dj, and the drain electrode coupled to the driving transistor TD.

The source electrode of the first switching transistor TS1 and the source electrode of the second switching transistor TS2 are coupled to the data line Dj at a second node N2.

The driving transistor TD includes the gate electrode coupled to the drain electrode of the first switching transistor TS1, the source electrode receiving the first power source voltage ELVDD, and the drain electrode coupled to the anode of the organic light emitting diode (OLED).

The first power source voltage ELVDD is supplied to the source electrode of the driving transistor TD through the power source wiring coupled to the power source voltage supplier 50, as shown in FIG. 1.

On the other hand, the source electrode of the light emission transistor TE is coupled to the driving transistor TD, and the drain electrode of the light emission transistor TE is coupled to the organic light emitting diode (OLED) of the pixel 60, and when the light emission signal EM is applied to the gate of the light emission transistor TE, the pixel 60 may emit light according to the data signal. Hereafter, it is assumed that the light emission transistor TE included in the pixel 60 is not turned on, because the supply of the light emission signal EM is stopped during a period for detecting the sensing current IPIXEL.

The organic light emitting diode (OLED) includes the anode coupled to the drain electrode of the light emission transistor TE, and the cathode coupled to the second power source voltage ELVSS. As described in FIG. 1, the second power source voltage ELVSS is supplied to the cathode of the organic light emitting diode (OLED) through a power source wire coupled to the power source voltage supplier 50.

The driving transistor TD, the first switching transistor TS1, the second switching transistor TS2, and the light emission transistor TE forming the pixel 60 of FIG. 2 may be p-channel type transistors. Accordingly, a gate-on voltage turning on the driving transistor TD, the first switching transistor TS1, the second switching transistor TS2, and the light emission transistor TE is a low level voltage, and a gate-off voltage for turning them off is a high level voltage.

The pixel 60 shown in FIG. 2 includes the p-channel type of thin film transistor. However, an embodiment of the present invention is not limited thereto. At least one of the driving transistor TD, the first switching transistor TS1, the second switching transistor TS2, and the light emission transistor TE may be an n-channel type transistor.

Next, a circuit operation of the pixel 60 and the sensor 32 of FIG. 2 will be described with reference to FIG. 3. Before a time t1, the low level voltage is applied to the non-inversion terminal (+) of the amplifier 320, and the second transistor T2 is turned on. At this time, when the scanning signal corresponding to the gate-on voltage is transmitted to the scanning line Si, the first switching transistor TS1 and the second switching transistor TS2 are turned on.

Figure 3:
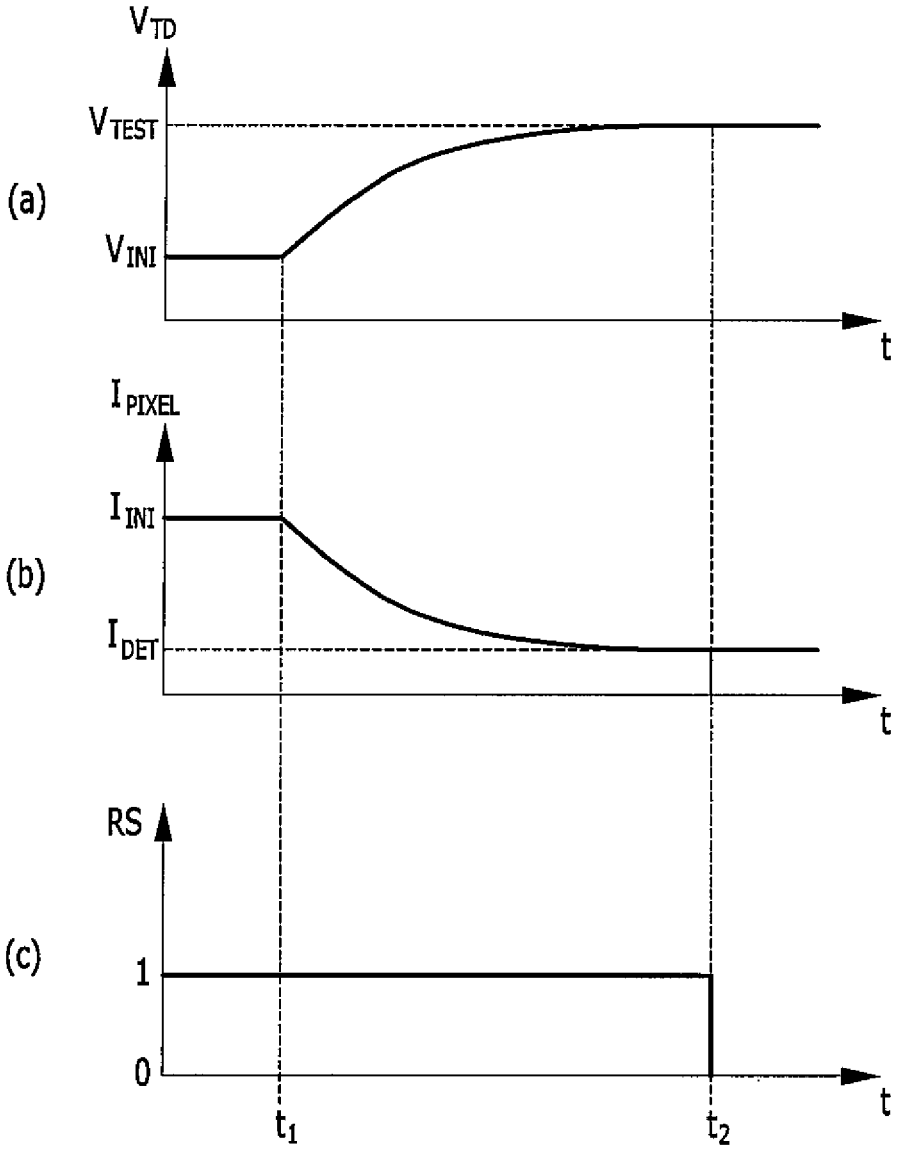
FIG. 3 is a measuring timing diagram of a pixel current of a display device according to an embodiment of the present invention.

Thus, as shown in FIG. 3 (*a*), an initial voltage VINI is applied to the gate of the driving transistor TD. The driving transistor TD may be operated like a diode including one terminal coupled to the first power source voltage ELVDD and the other terminal coupled to the drain electrode of the second switching transistor TS2.

Thus, as shown in FIG. 3 (*b*), the initial current IINI by the first power source voltage ELVDD flows to the j-th data line Dj. Accordingly, the initial current IINI flows to the turned-on switching element RS according to the second transistor T2.

Next, at the time t1, the test voltage VTEST is applied to the non-inversion terminal (+) of the amplifier 320, and the voltage of the first node N1 is maintained as the test voltage VTEST.

After the time t1, as shown in FIG. 3 (*a*), the voltage of the second node N2 is increased. When the voltage of the second node N2 is increased, the voltage applied to the gate of the driving transistor TD is increased. Also, as shown in FIG. 3 (*b*), the current flowing to the driving transistor TD is decreased. The decreased current flows to the turned-on switching element RS of the current sensor 324.

At the time t2, when the voltage of the second node N2 is substantially equivalent to the test voltage VTEST, the switching element RS is turned off by the controller 40. Accordingly, the sensing current IPIXEL flowing to the driving transistor TD flows to the current mirrors T3 and T4 through the transistor T2.

As shown in FIG. 3 (*b*), by the first power source voltage ELVDD applied to the source electrode of the driving transistor TD, and by the test voltage VTEST applied to the drain electrode and the gate electrode, the sensing current IPIXEL has a smaller value than the initial current IINI.

Thus, a detection current IDET, which has the same value as the sensing current IPIXEL supplied to the third transistor T3, flows to the fourth transistor T4.

Next, referring to FIG. 4, a structure of the pixel 60 included in the display unit 10 and a structure of the sensor 32 connected to the pixel 60 in the display device according to another embodiment of the present invention will be described.

Figure 4:
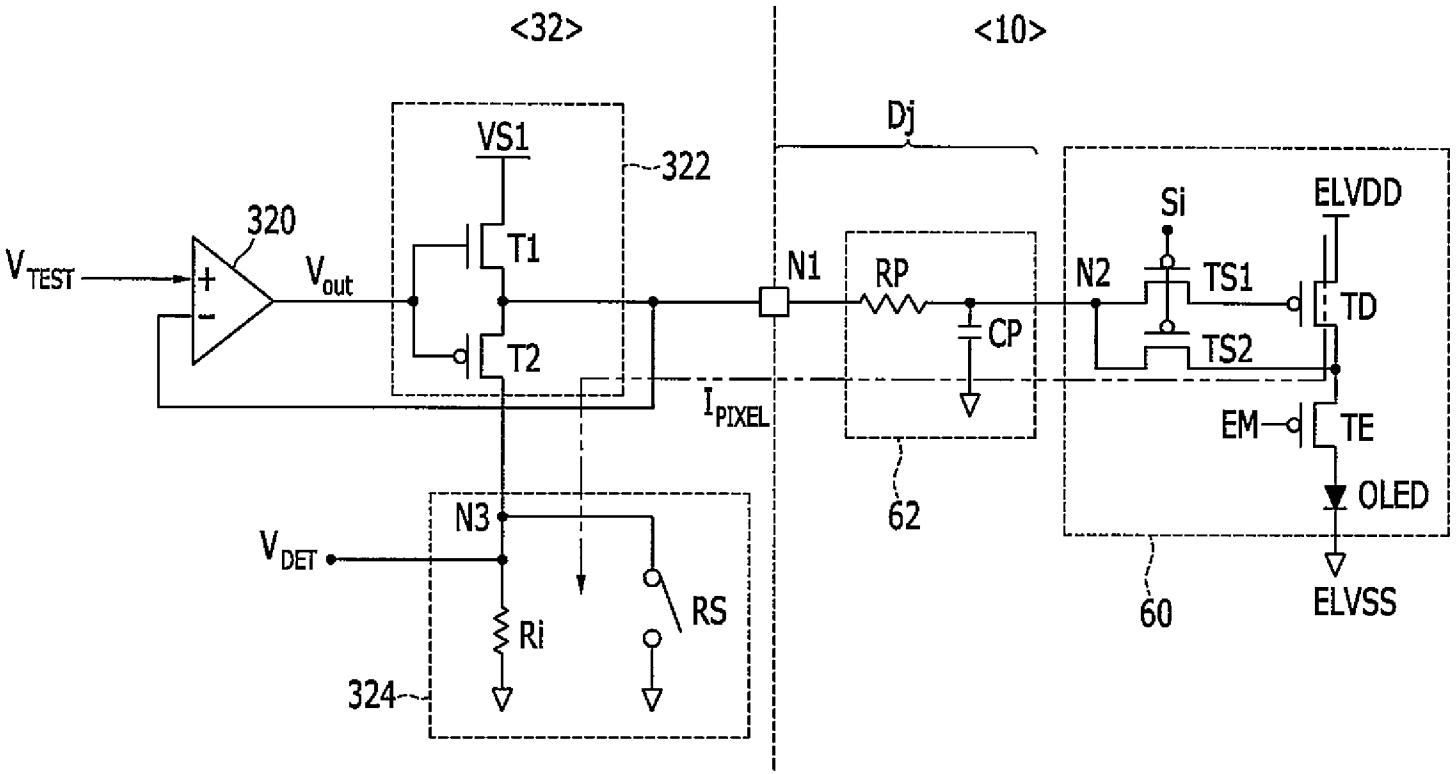
FIG. 4 is a circuit diagram of one example of a display unit and a sensor of a display device according to another embodiment of the present invention.

FIG. 4 is a circuit diagram showing one example of a display unit 10 and a sensor 32 of a display device according to another embodiment of the present invention. As shown, the sensor 32 may include the amplifier 320, the output terminal 322, and the current sensor 324, and may be coupled to the j-th data line Dj.

At this time, because the amplifier 320 and the output terminal 322 are substantially equally operated as shown in FIG. 2, the current sensor 324 will be described hereafter.

The current sensor 324 may include the switching element RS and the sensing resistor Ri. The switching element RS and the sensing resistor Ri may be coupled together at the third node N3.

When the current flows from the other terminal of the second transistor T2 to the sensing resistor Ri, by a resistance value of the sensing resistor Ri, the voltage is generated to the third node N3.

For example, when the switching element RS is turned off, the current inflowed from the second transistor T2 flows to the sensing resistor Ri. Thus, the voltage VDET of the third node N3 coupled to the sensing resistor Ri and the second transistor T2 may be detected by the voltage compensator.

The sensing current IPIXEL may be detected by using Equation 1, the sensing resistance value Ri, and the detected voltage value VDET.

$$I_{PIXEL} = \frac{V_{DET}}{Ri} \qquad \text{Equation 1}$$

Here, IPIXEL may be the sensing current, VDET may be the voltage value of the third node N3, and Ri may be the sensing resistance value.

As shown in FIG. 3, the sensor 32 shown in FIG. 4 may detect the sensing current IPIXEL according to the test voltage VTEST as the detection voltage VDET. The sensor 32 and the pixel 60 may detect the sensing current IPIXEL flowing to the driving transistor TD according to the test voltage VTEST applied to the amplifier 320 by using the sensing resistor Ri.

In FIG. 4, the pixel 60 includes four transistors, however the pixel circuit of the display device is not limited thereto and may be variously configured.

Next, referring to FIG. 5, a structure of the pixel 60 included in the display unit 10 and a structure of the sensor 32 connected to the pixel 60 in the display device according to another embodiment of the present invention will be described.

Figure 5:
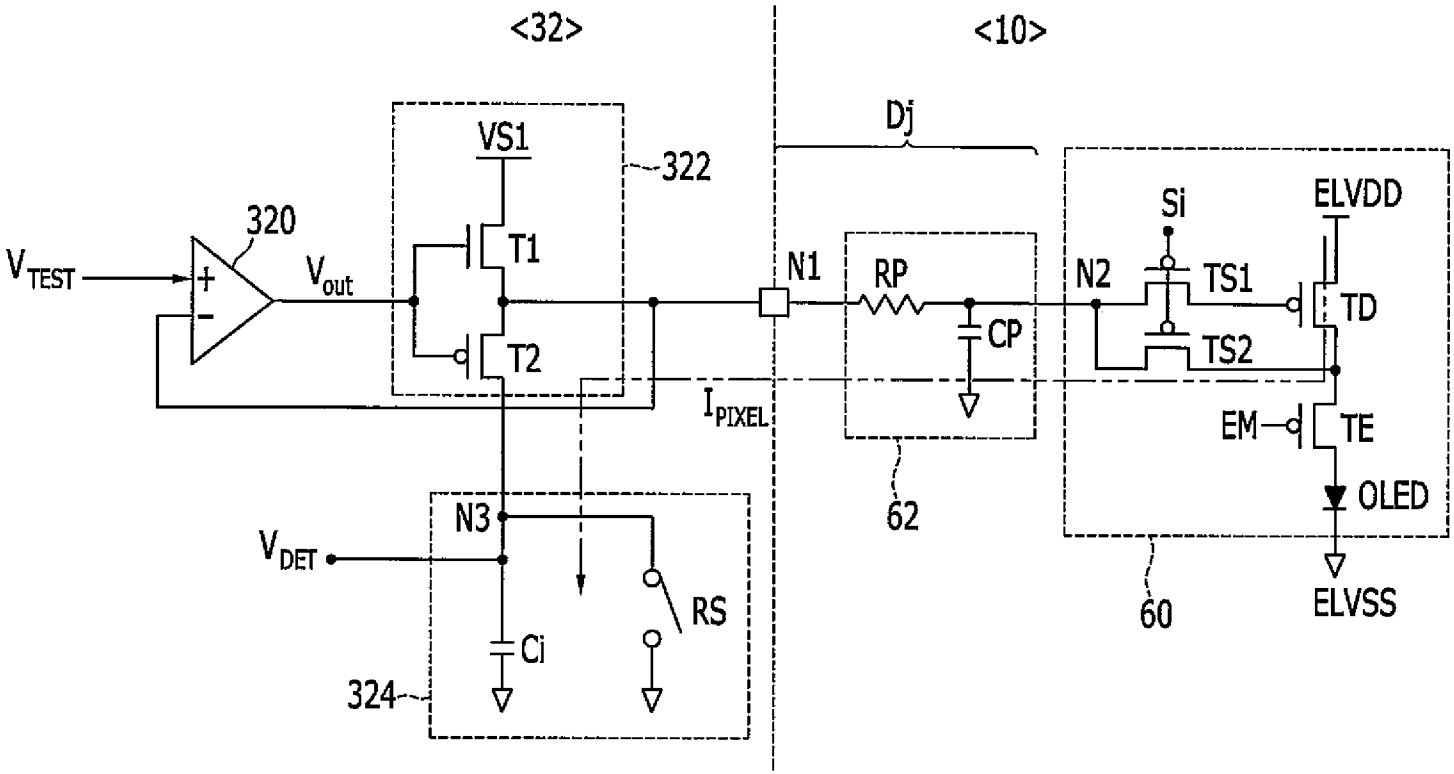
FIG. 5 is a circuit diagram of one example of a display unit and a sensor of a display device according to another embodiment of the present invention.

FIG. 5 is a circuit diagram showing one example of a display unit 10 and a sensor 32 of a display device according to another embodiment of the present invention. As shown, the sensor 32 may include the amplifier 320, the output terminal 322, and the current sensor 324, and may be coupled to the j-th data line Dj.

At this time, because the amplifier 320 and the output terminal 322 are operated in substantially the same manner shown in FIG. 2, the current sensor 324 will be described.

The current sensor 324 may include the switching element RS and the sensing capacitor Ci. The switching element RS and the sensing capacitor Ci may be coupled together at node N3, which is coupled to the other terminal of the second transistor T2.

When the current is supplied to the sensing capacitor Ci from the other terminal of the second transistor T2, the voltage is generated at the third node N3.

For example, when the switching element RS is turned off, the current inflowed from the second transistor T2 charges the sensing capacitor Ci. Thus, the data compensator 34 may detect the voltage of the third node N3 to which the sensing capacitor Ci and the second transistor T2 are coupled. The sensing current IPIXEL may be detected from the detected voltage value and the value of the sensing capacitor Ci by using Equation 2.

$$I_{PIXEL} = \frac{V_{DET}}{Ci \times T_{INT}} \quad \text{Equation 2}$$

Here, IPIXEL may be the sensing current, VDET may be the voltage value of the fourth node, Ci may be the capacitance value of the sensing capacitor Ci, and TINT may be a predetermined time.

As shown in FIG. 3, the sensor 32 shown in FIG. 5 may detect the sensing current IPIXEL according to the test voltage VTEST. The sensor 32 and the pixel 60 may detect the sensing current IPIXEL flowing to the driving transistor TD according to the test voltage VTEST applied to the amplifier 320 by using the sensing capacitor Ci.

In FIG. 5, the pixel 60 includes four transistors, however the pixel circuit of the display device is not limited thereto, and may be variously configured.

The structure of the sensor 32 and the pixel 60 of the present invention is not limited to the example embodiments shown in FIG. 2, FIG. 4, and FIG. 5, and each configuration may be replaced without undue experimentation by those skilled in the art.

The drawings and the detailed description described above are example embodiments of the present invention and are provided to explain the present invention, and the scope of the present invention described in the claims is not limited thereto. Therefore, it will be appreciated by those skilled in the art that various modifications may be made and other equivalent embodiments are available. In addition, a person of ordinary skill in the art may omit some of the components described in the present specification without deteriorating the performance, or may add components in order to improve the performance. Further, a person of ordinary skill in the art may change the sequence of processes described in the present specification according to the process environments or equipment. Therefore, the scope of the present invention should be defined by the appended claims and equivalents, not by the described example embodiments.

| Description of Some of the Reference Characters | |
|---|---|
| 10: display unit | 20: scan driver |
| 30: data driver | 32: sensor |
| 34: data compensator | 40: controller |
| 50: power source voltage supplier | 60: pixel |

What is claimed is:

1. A display device comprising:

a pixel configured to emit light according to a data signal supplied to a data line;

a power source voltage supplier configured to supply a power source voltage to the pixel;

a driving transistor configured to drive the pixel according to the data signal and the power source voltage; and a sensor configured to supply a test signal to the data line and to detect a sensing current flowing to the data line through the driving transistor according to the test signal, wherein the sensor comprises:

an amplifier configured to generate an output voltage according to a voltage difference input to a plurality of input terminals;

a first transistor comprising a first terminal coupled to a voltage source, and a second terminal coupled to the data line and to the input terminal of the amplifier at a first node;

a current sensor coupled to the first node and configured to detect the sensing current;

a second transistor comprising a first terminal coupled to the current sensor, and a second terminal coupled to the first node; and a switching element coupled to the first node and configured to be turned off in order to detect the sensing current according to the test signal.

2. The display device of claim 1, wherein the first transistor is configured to operate according to the output voltage and is configured to supply a current supplied from the voltage source to the first node.

3. The display device of claim 1, further comprising:

a first switching transistor comprising a first terminal coupled to the data line, and a second terminal coupled to a gate of the driving transistor and configured to operate according to a scanning signal supplied to a scan line; and a second switching transistor comprising a first terminal coupled to the driving transistor, and a second terminal coupled to the first switching transistor at a second node and configured to operate according to the scanning signal.

4. The display device of claim 3, wherein the switching element, which is configured to drive the sensing current, is configured to be turned off when a voltage of the second node is substantially equivalent to a voltage of the test signal.

5. The display device of claim 1, wherein the current sensor comprises a current mirror.

6. The display device of claim 1, wherein the current sensor comprises a sensing resistor, and is configured to detect a voltage of the sensing resistor according to the sensing current.

7. The display device of claim 1, wherein the current sensor comprises a sensing capacitor, and is configured to detect a charged voltage of the sensing capacitor corresponding to the sensing current.

8. The display device of claim 1, further comprising a data compensator configured to compensate the data signal as a compensation value corresponding to a value of the sensing current.

9. A method for driving a display device comprising a pixel configured to emit a light according to a data signal supplied to a data line, a power source voltage supplier configured to supply a power source voltage to the pixel, and a driving transistor configured to drive the pixel according to the power source voltage, the method comprising:

supplying a test signal to the driving transistor through the data line; and detecting a sensing current flowing to the data line according to the test signal through the driving transistor, wherein a switching element of a sensor is turned off in order to detect the sensing current according to the test signal, and wherein the sensor comprises:

the switching element;

an amplifier configured to generate an output voltage according to a voltage difference input to a plurality of input terminals;

a first transistor comprising a first terminal coupled to a voltage source, and a second terminal coupled to the data line and to the input terminal of the amplifier at a first node;

a current sensor coupled to the first node and configured to detect the sensing current; and a second transistor comprising a first terminal coupled to the current sensor, and a second terminal coupled to the first node.

10. The method of claim 9, wherein the supply of the test signal further comprises:

supplying a scanning signal to a scan line coupled to a gate of a first switching transistor comprising a first terminal coupled to the data line, and a second terminal coupled to a gate of the driving transistor, and supplying the scanning signal to the scan line coupled to a gate of a second switching transistor comprising a first terminal coupled to the driving transistor, and a second terminal coupled to the first switching transistor at a second node.

11. The method of claim 10, wherein the detecting the sensing current comprises stopping a driving of the switching element coupled to the first terminal of the second transistor to supply the sensing current to the current sensor when a voltage of the second node is substantially equivalent to a voltage of the test signal.

12. The method of claim 9, wherein the current sensor comprises a current mirror, and wherein a current output from the current mirror is detected in the detecting of the sensing current.

13. The method of claim 9, wherein the current sensor comprises a sensing resistor, and wherein a voltage value of the sensing resistor corresponding to the sensing current is detected in the detecting of the sensing current.

14. The method of claim 9, wherein the current sensor comprises a sensing capacitor, and wherein a charged voltage value of the sensing capacitor corresponding to the sensing current is detected in the detecting of the sensing current.

15. The method of claim 9, further comprising compensating the data signal as a compensation value corresponding to a value of the sensing current.

* * * * *